US006772909B2

(12) United States Patent
Bateman

(10) Patent No.: US 6,772,909 B2
(45) Date of Patent: Aug. 10, 2004

(54) BAG DISPENSER

(75) Inventor: Patricia Mary Bateman, Oroville, CA (US)

(73) Assignee: Roplast Industries, Inc., Oroville, CA (US)

( * ) Notice: Subject to any disclaimer, the term of this patent is extended or adjusted under 35 U.S.C. 154(b) by 63 days.

(21) Appl. No.: 10/195,552

(22) Filed: Jul. 16, 2002

(65) Prior Publication Data

US 2003/0150871 A1 Aug. 14, 2003

Related U.S. Application Data

(60) Provisional application No. 60/356,169, filed on Feb. 14, 2002.

(51) Int. Cl.[7] ..... G07F 11/16

(52) U.S. Cl. ..... 221/305; 206/554

(58) Field of Search ..... 221/56, 58, 63, 221/33, 305; 206/554

(56) References Cited

U.S. PATENT DOCUMENTS 1,609,186 A * 11/1926 Peruzzi ..... 206/45.29
2,604,253 A * 7/1952 Turner ..... 206/493
2,725,141 A * 11/1955 Latvala et al. ..... 206/554
3,162,305 A * 12/1964 Schoppa ..... 206/493
3,422,988 A * 1/1969 Lafranca ..... 221/58
3,583,597 A * 6/1971 Buttery et al. ..... 221/33
3,724,716 A * 4/1973 Baraconi et al. ..... 221/47
4,207,984 A * 6/1980 Kelly et al. ..... 206/554
4,366,916 A * 1/1983 Guido et al. ..... 229/103
4,512,476 A * 4/1985 Herrington, Jr. ..... 206/554
4,557,384 A * 12/1985 Membrino ..... 206/554
4,611,728 A * 9/1986 Compton et al. ..... 221/63
4,805,800 A * 2/1989 Nocek et al. ..... 221/63
5,310,057 A * 5/1994 Caldwell et al. ..... 206/494
5,577,612 A * 11/1996 Chesson et al. ..... 206/494
5,577,615 A * 11/1996 Wile et al. ..... 206/554
5,579,915 A * 12/1996 Liss ..... 206/554
5,655,682 A * 8/1997 Hoffrichter ..... 221/45
5,678,728 A * 10/1997 Leto ..... 221/185
5,695,065 A * 12/1997 Kennedy et al. ..... 206/554
5,860,529 A * 1/1999 Smithson et al. ..... 206/554
5,924,559 A * 7/1999 Carrel et al. ..... 206/45.21
5,927,516 A * 7/1999 Berry ..... 211/51
5,971,155 A * 10/1999 Liang ..... 206/554
5,979,841 A * 11/1999 Piraneo et al. ..... 248/95
6,267,262 B1 * 7/2001 Wilner ..... 221/45
6,367,654 B1 * 4/2002 Simpson ..... 221/58
6,557,723 B2 * 5/2003 Chen ..... 221/45
6,564,963 B2 * 5/2003 Simpson ..... 221/58

* cited by examiner

*Primary Examiner*—Donald P. Walsh
*Assistant Examiner*—Matthew J. Kohner
(74) *Attorney, Agent, or Firm*—Burns Doane Swecker & Mathis, L.L.P.

(57) ABSTRACT

A bag dispenser formed from a planar sheet of material, wherein a portion of the planar sheet is cut to form a bendable flap, the flap having a first portion and a second portion, wherein the first portion has a length greater than the second portion.

8 Claims, 7 Drawing Sheets

13
10
12
14
14
25
11
15
15

BAG DISPENSER

PRIORITY CASE

This application claims priority under 35 U.S.C. §119 to U.S. Provisional Application No. 60/356,169 entitled Bag Dispenser and filed on Feb. 14, 2002, the entire content of which is hereby incorporated by reference.

SUMMARY OF THE INVENTION

The present invention provides a bag dispenser which is formed from a bendable planar sheet of material. The planar sheet of material may comprise a sheet of corrugated cardboard which is pre-cut into a desired shape such that it can conveniently be folded into the present inventive bag dispenser.

In preferred aspects, the present invention comprises a bag dispenser formed from a planar sheet of material, wherein a portion of the planar sheet is cut to form a bendable "two-part" flap having a first portion and a second portion. Specifically, the first portion of the "two-part" flap extends from the planar material and the second portion of the "two-part" flap extends from the first portion of the "two-part" flap.

Most preferably, the portion of the planar sheet is cut to form the bendable "two-part" flap is an "internal" portion of the planar sheet. (IE: a portion of the sheet which is away from the edges of the sheet).

In preferred aspects, the present "two-part" flap operates to hold a plurality of bags in alignment within the bag dispenser. Most preferably, the bags are plastic, although the present invention is not so limited. Advantageously, the bags can conveniently be removed from the dispenser one-by-one without inadvertently releasing a number of bags in clumps or bunches.

This novel dispensing effect of the present invention is preferably achieved by having the length of the first portion (i.e. the distance that it projects away from the planar sheet) be greater than the length of the second portion of the flap (i.e. the distance that it projects away from the first portion of the flap).

Preferably, the bag dispenser is dimensioned such that its front and back are spaced a distance apart which is less than the length of the first portion of the two-part flap.

As such, when the second portion of the flap is folded up against the first portion of the flap and the first portion of the flap is folded up against the sheet of planar material, the second portion of the flap will tend to push the first portion of the flap away from the planar sheet of material. Thus, the flap tends to act as a "spring" pushing against the bags. The bag dispenser is preferably narrow enough (IE: its front and back are close enough together) such that a plurality of bags are grasped and held between the spring acting dual portion flap on the front of the bag dispenser and the flat back of the bag dispenser.

Consequently, when the present bag dispenser is placed on its end (such that the bags are standing next to one another), the bags will be prevented from sliding downwards and crumpling at the bottom end of the box. Instead, the present system advantageously permits the remaining bags to be held such that they stand vertically next to one another, even after many of the bags have been removed from the dispenser.

In preferred aspects, a single planar sheet of material is simply bent to form the front, back, bottom and sides of the bag dispenser.

An important advantage of the present invention is that it dispenses bags one at a time, while keeping sequential bags in a neatly pressed condition such that the bags do not crinkle prior to use. This is especially important in the case of plastic bags used by high-end department and clothing stores.

A further advantage of the present invention is that it provides a very convenient place in which to store bags prior to giving them to store customers.

A further advantage of the present invention is that, prior to its assembly, it is simply a planar piece of pre-cut material. Thus, many of the present bag dispensers can be bundled together in a rather small pack age and shipped to customers.

Moreover, the present invention is simply assembled by folding it. Thus, a further advantage of the present invention is that it is very easy to assemble.

A further advantage of the present invention is that it has large flat surfaces on which advertising or corporate logos may conveniently be printed.

DETAILED DESCRIPTION OF THE DRAWINGS

Figure 1:
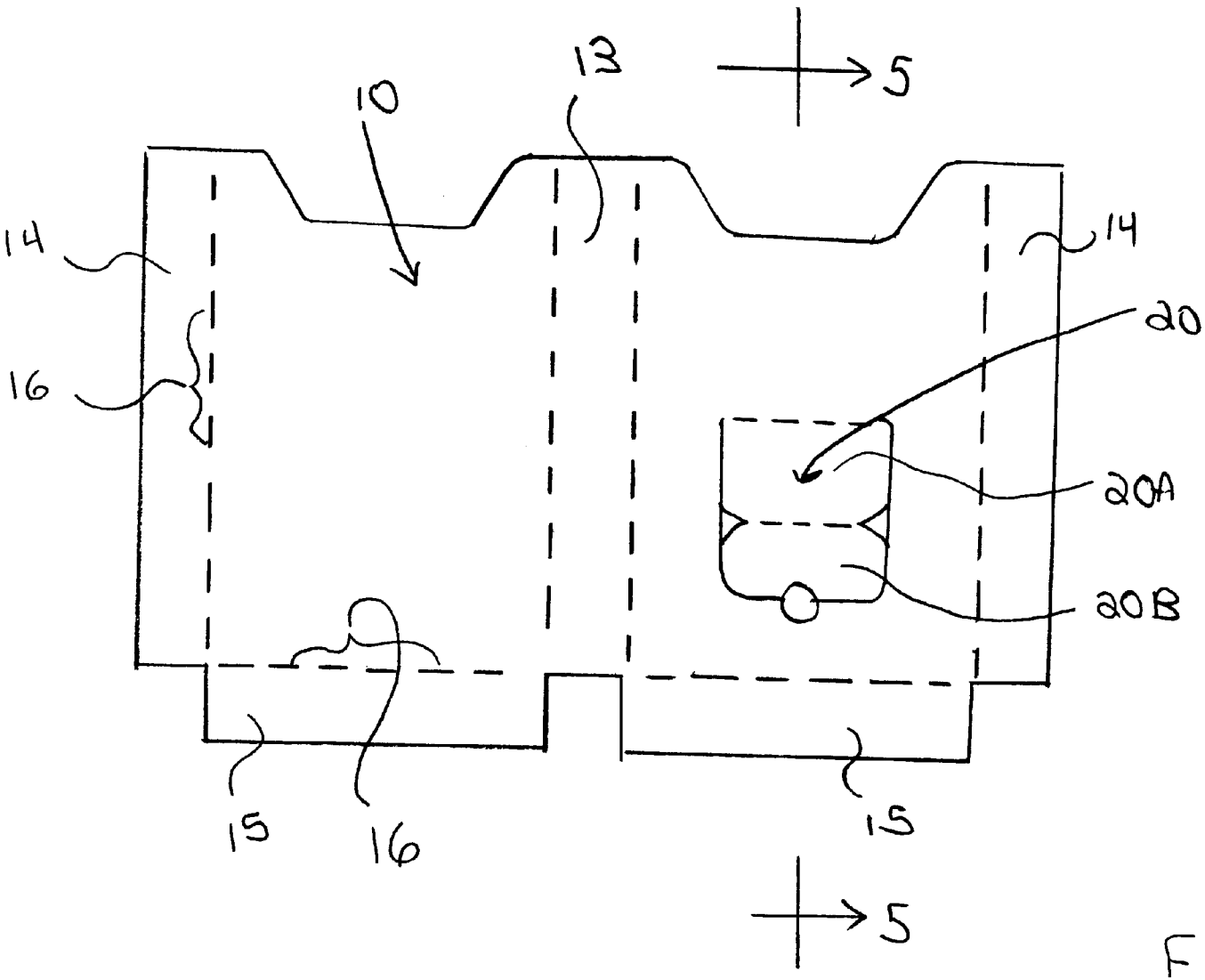
FIG. 1 shows a first embodiment of the invention (prior to it being folded into a bag dispenser).
Figure 2:
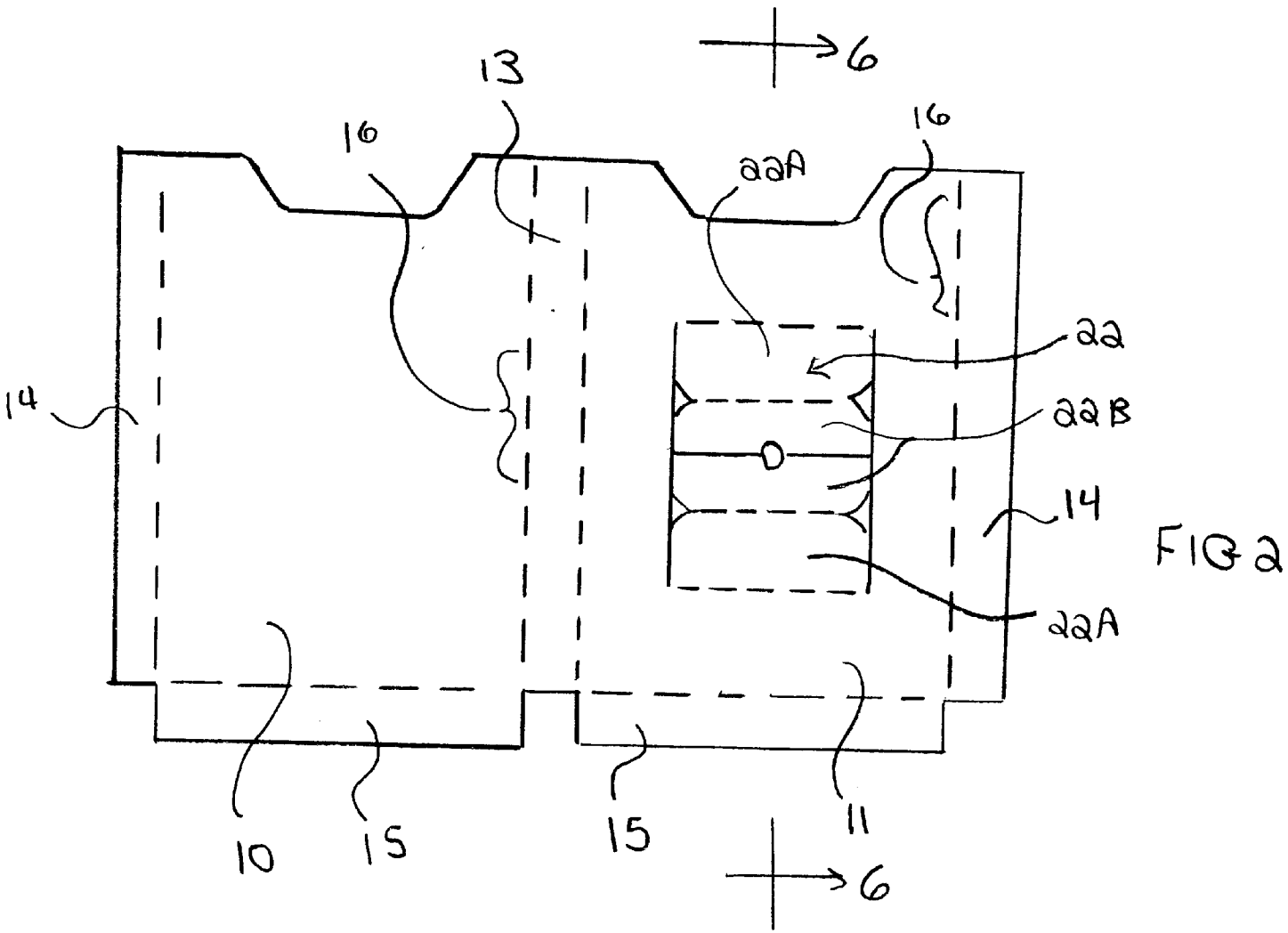
FIG. 2 shows a second embodiment of the invention (prior to it being folded into a bag dispenser).

Referring first to FIGS. 1 and 2, two different embodiments of bag dispenser 10 are shown. As will be explained, FIG. 1 shows a single two-part flap design and FIG. 2 shows a double two-part flap design. In accordance with the present invention, bag dispenser 10 is formed by folding a single sheet of material (preferably corrugated cardboard) into the shape of the bag dispenser.

Planar sheet 10 is shaped with a plurality of continuous contacting regions which, when folded, form front 11, back 12, first side 13, second side 14 and bottom 15 (FIG. 2). As shown in FIG. 1, planar sheet 10 is folded along various fold lines 16 (shown dotted) so as to form the present bag dispenser.

Figure 3:
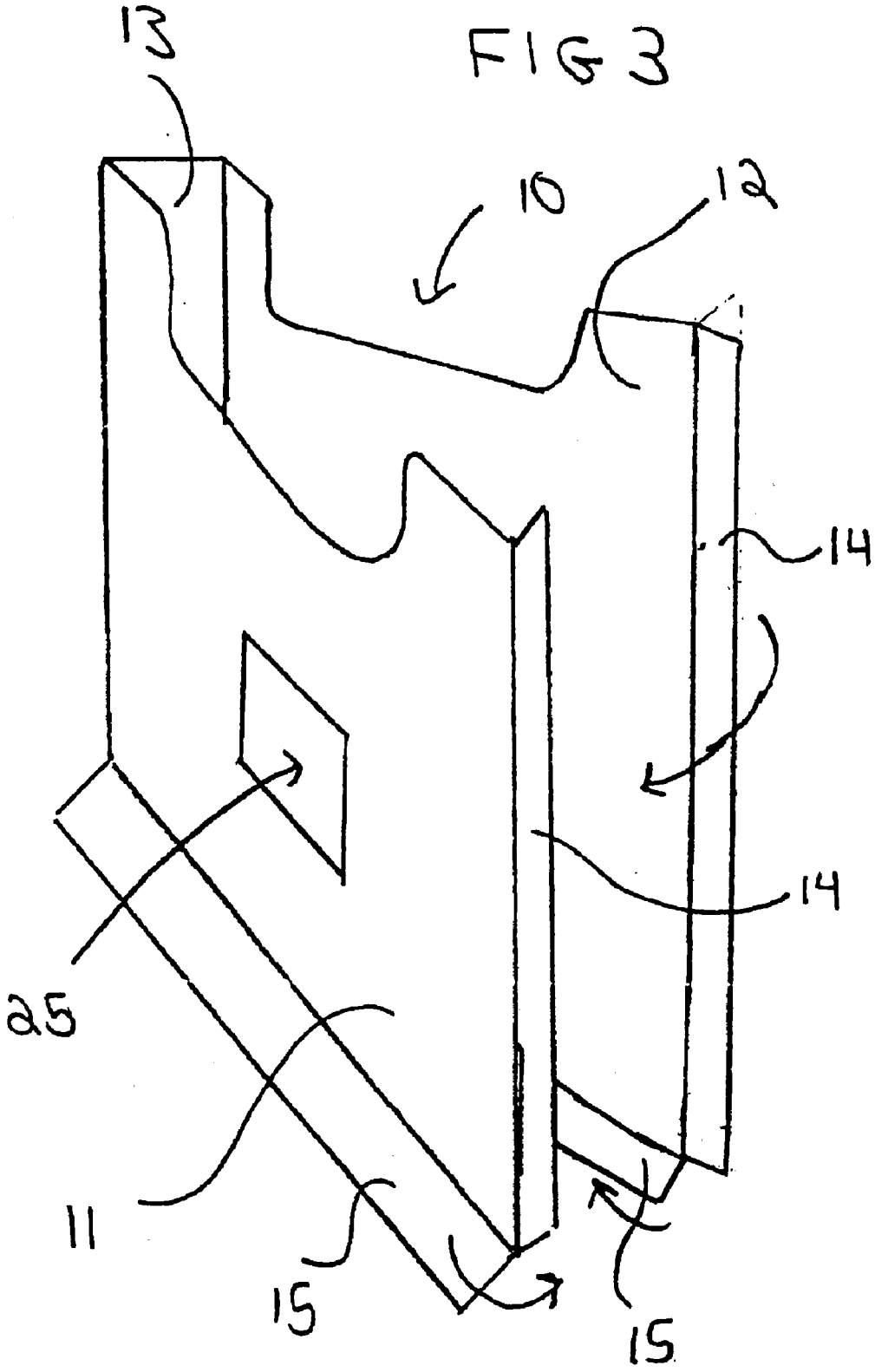
FIG. 3 shows a partially assembled view of the present invention.

A partially assembled view of bag dispenser 10 is shown in FIG. 3. Sides 14 and bottom portions 15 can be taped together so as to hold the dispenser shut.

In accordance with the invention, at least one two-part flap is used to hold the bags in the dispenser. In this regard, FIG. 1 illustrates an embodiment of the invention with a single two-part flap 20; and FIG. 2 illustrates an embodiment of the invention with two two-part flaps 22. Flap 20 has a first portion 20A and a second portion 20B. Flap 22 has a first portion 22A and a second portion 22B.

Figure 4:
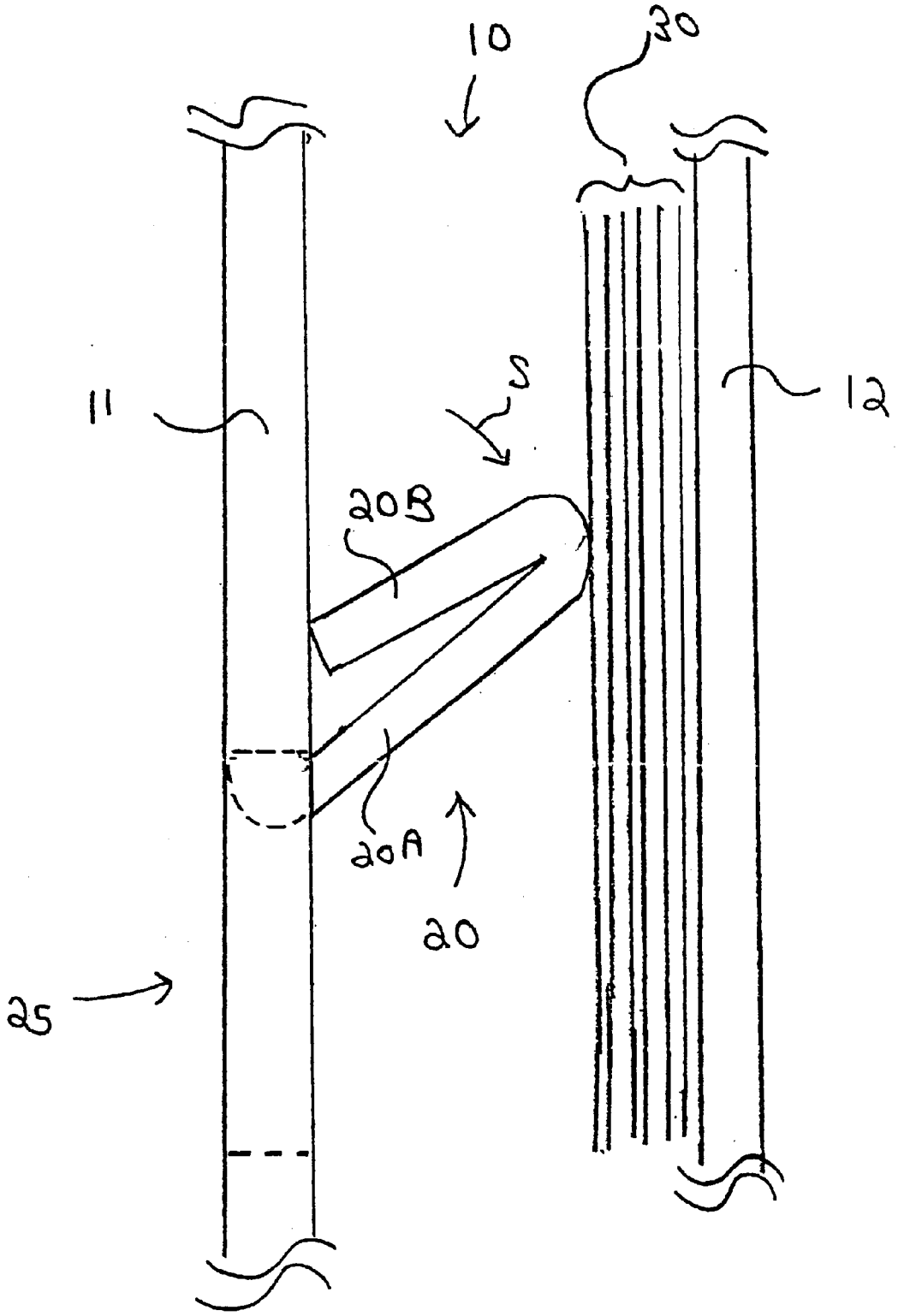
FIG. 4 shows a side elevation view with one of the sides removed, showing the internal operation of the bag dispenser.

FIG. 4 shows the set-up of the "spring" mechanism of the two-part flap as used to hold bags 30 in place. Thus, individual bags remain vertically oriented, standing next to one another, even after a number of the bags have been removed from dispenser 10.

Specifically, when portion 20B is folded up against portion 20A and portion 20A is folded up against the inside of front 11, a two-part spring-acting flap will be formed. IE: portion 20 will tend to move in direction S, thus holding bags 30 in position against back 12. As can be seen, when the user pushes on portions 20A and 20B, a "window" 25 will be opened in the front 11 of the dispenser.

Figure 5A:
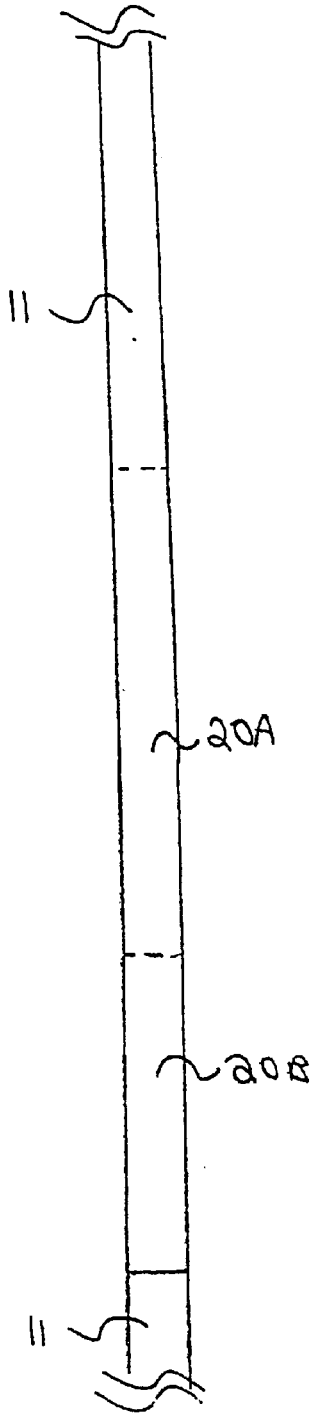
FIGS. 5A to 5C show sequential steps in folding the two-part flap, with the views taken along line 5—5 in FIG. 1.
Figure 5B:
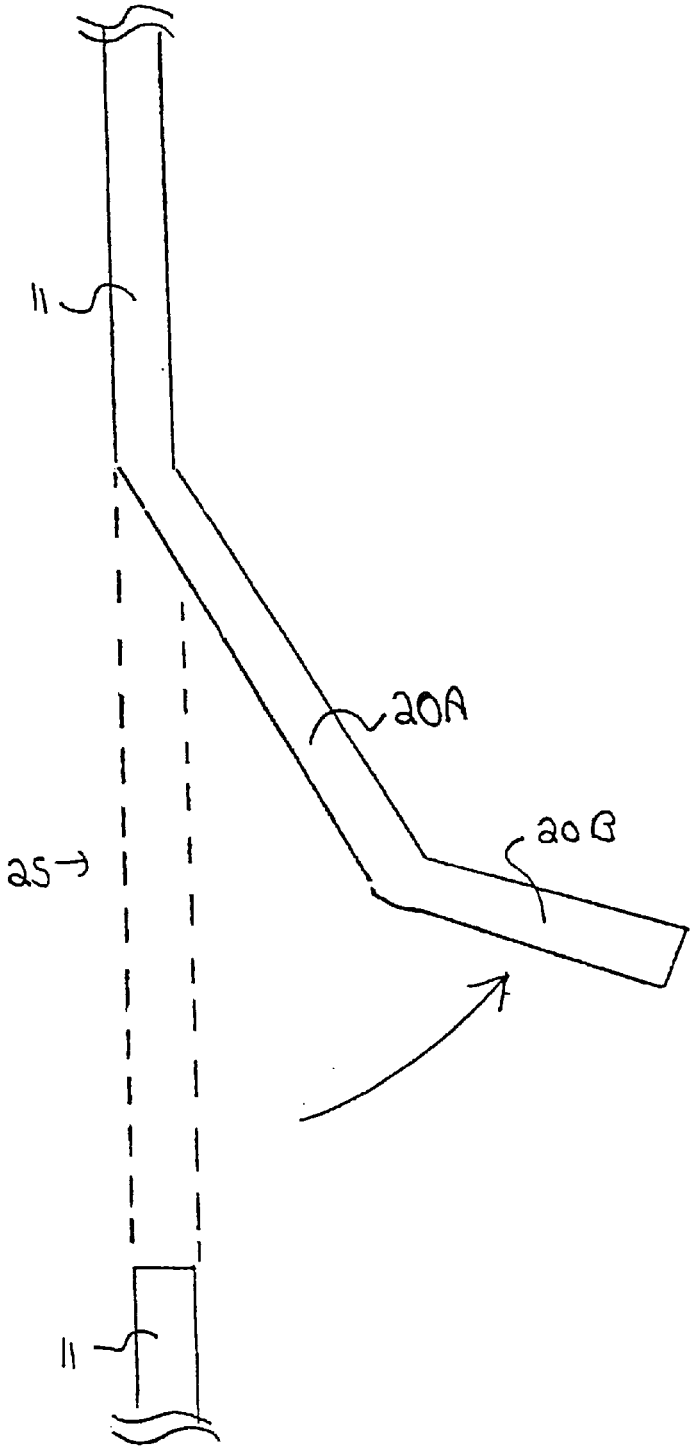
Figure 5C:
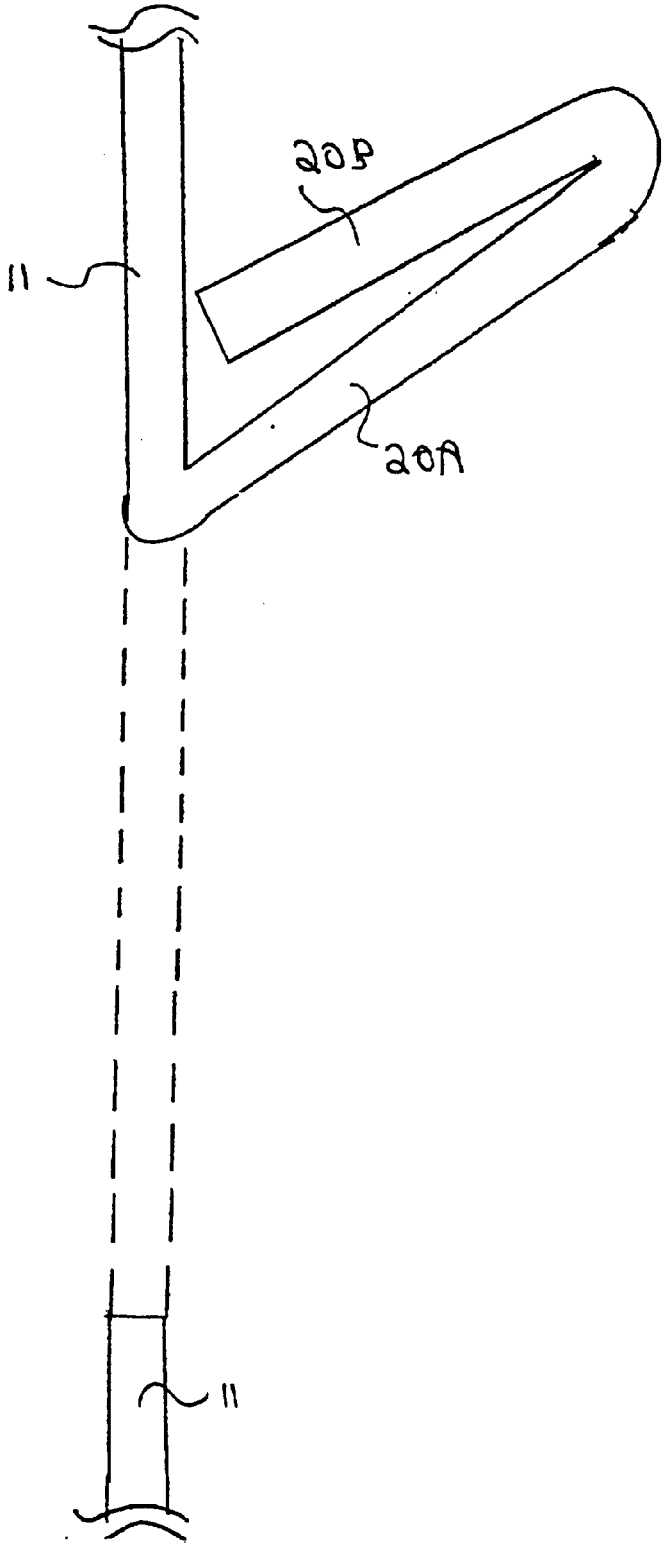
Figure 6:
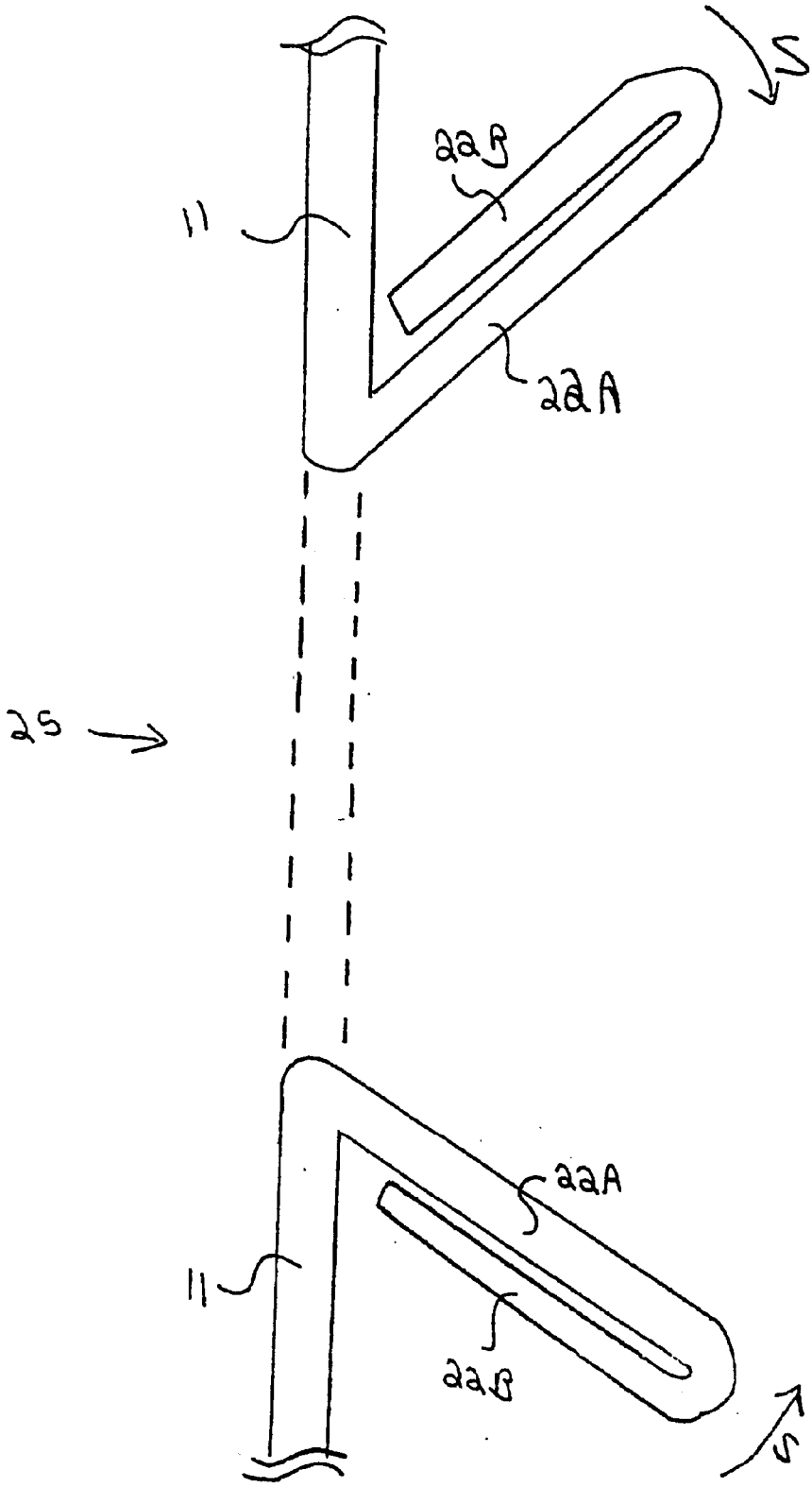
FIG. 6 shows a view taken along line 6—6 in FIG. 2 after the 2 two-part flaps have been folded into an operating position.

FIGS. 5A to 5C show the respective positions of portions 20A and 20B as the two-part flap is formed. Preferably, the length of first portion 20A is longer than the length of second portion 20B. Thus, portion 20B can be folded within portion 20A and front 11 (as shown in FIG. 4).

in FIG. 2, two separate flaps 22 are formed. FIG. 6 shows a view taken along line 6—6 in FIG. 2 after the two two-part flaps have been folded into an operating position (ie: such that they would spring back (in directions S) to hold a plurality of bags 30 (not shown) against the back 12 (not shown) of the bag dispenser 10.

What is claimed is:

1. A bag dispenser, comprising:

a planar sheet of material, wherein a portion of the planar sheet is cut to form a bendable flap, the flap having a first portion and a second portion, wherein the first portion has a length greater than the second portion, and wherein the first portion of the flap projects from the planar sheet of material and the second portion of the flap projects from the first portion of the flap, and wherein the first portion of the flap springs outwardly away from the planar sheet of material when the second portion of the flap has been folded against the first portion of the flap and the first portion of the flap has been folded against the planar sheet of material.

2. The bag dispenser of claim 1, wherein the bendable flap is cut from an internal section of the planar sheet of material.

3. The bag dispenser of claim 1, wherein the planar sheet of material is corrugated cardboard.

4. The bag dispenser of claim 1, wherein the planar sheet of material is bent to form a front, a back, a bottom and two sides of the bag dispenser.

5. The bag dispenser of claim 1, further comprising: a plurality of plastic bags received in the bag dispenser.

6. The bag dispenser of claim 1, wherein the portion of the planar sheet which is cut to form a bendable flap comprises a pair of bendable flaps, each bendable flap having a first portion and a second portion, wherein the first portion has a length greater than the second portion.

7. The bag dispenser of claim 1, wherein the planar sheet of material is folded such that a portion of the planar sheet of material forms a front and a back of the bag dispenser and wherein the length of the flap is greater than the separation distance between the front and back of the bag dispenser.

8. The bag dispenser of claim 7, wherein the length of the first portion of the flap is greater than the separation distance between the front and back of the bag dispenser.

* * * * *